United States Patent [19]

Gingrande

[11] Patent Number: 4,833,828

[45] Date of Patent: May 30, 1989

[54] EASY-OPEN KENNEL DOOR

[75] Inventor: Arthur Gingrande, Boxford, Mass.

[73] Assignee: Gertrude Freedman, Boxford, Mass.

[21] Appl. No.: 187,922

[22] Filed: Apr. 29, 1988

[51] Int. Cl.[4] ..... E05F 1/10

[52] U.S. Cl. ..... 49/386; 49/392

[58] Field of Search ..... 49/392, 390, 386, 393, 49/168, 169; 119/19

[56] References Cited

U.S. PATENT DOCUMENTS

| | | | |
|---|---|---|---|
| 82,648 | 9/1868 | Smith . | |
| 229,502 | 6/1880 | Wagner | 49/390 X |
| 270,309 | 1/1883 | Harrison et al. | 49/386 X |
| 447,819 | 3/1891 | Gorham . | |
| 488,761 | 12/1892 | Giesey . | |
| 532,201 | 1/1895 | Hines . | |
| 558,387 | 4/1896 | Heilprin . | |
| 655,897 | 8/1900 | Essig . | |
| 1,004,672 | 10/1911 | Molby | 49/393 |
| 1,084,204 | 1/1914 | Ely . | |
| 1,303,406 | 5/1919 | Smith . | |
| 1,630,200 | 5/1927 | Merrill . | |
| 2,505,467 | 4/1950 | Eilbert . | |
| 2,750,015 | 6/1956 | Hauck | 49/392 |
| 2,869,691 | 1/1959 | Evans et al. | 49/392 |
| 2,960,964 | 11/1960 | Murphy . | |
| 3,039,134 | 6/1962 | Schwarz . | |
| 3,184,803 | 5/1965 | Peel . | |
| 4,078,333 | 3/1978 | Lussier | 49/393 X |

*Primary Examiner*—Philip C. Kannan

*Attorney, Agent, or Firm*—Fish & Richardson

[57] ABSTRACT

A kennel door which pivots about a vertical axis that bisects the door. The door is mounted within an opening in a frame. Disposed along the periphery of the frame are door seals which provide both a stop against which the door comes to rest and a seal against weather coming in through the opening when the door is in a closed position. When the door is in a closed position, the door seals are situated on diametrically opposite sides of the door such that they permit the door to rotate in one direction through the opening but not in the other direction. A spring biases the door in a closed position resting against the door seals.

2 Claims, 1 Drawing Sheet

EASY-OPEN KENNEL DOOR

FIELD OF THE INVENTION

This invention relates generally to the field of pet doors, and, more particularly, to an easy-open, vertically pivoted pet door for use in a kennel.

BACKGROUND OF THE INVENTION

Kennels often use cages having at least two compartments, one located inside the building offering protection from bad weather and the other located outside the building offering access to fresh air and sunshine during good weather. A kennel door typically separates the two compartments and serves to permit the animal to move freely between them, while at the same time protecting the inside of the building from the weather and insects found outside. Predictably, the kennel environment imposes special requirements on such doors which are different, in degree and in kind, from the requirements imposed on doors used by humans. For example, an animal must be able to easily operate the door to both enter and exit the building without human assistance. After each time the animal has passed through the door, the door must automatically and effectively close and protect the interior space from the outside conditions. In addition, the door must be capable of withstanding unusual and considerable abuse without breaking. In the past, however, kennel doors have not satisfactorily met all these requirements.

Kennel doors have characteristically been of two types: doors which are hinged at the top and doors which are hinged on one side. Both of these designs have shortcomings. They are prone to flying open in a stiff wind unless provided with a strong hinge-spring, a magnet or other mechanism to hold them closed. These mechanisms, however, are not altogether satisfactory solutions to the problem. The hinge-spring, which is a torsional spring oriented along the axis of the hinge, discourages the animal, particularly puppies and small dogs, from using the door by making the door more difficult to open. Moreover, because the hinge-spring is part of the hinge, shielding it from the moisture and corrosive conditions typically present in the kennel is very difficult. Thus, it tends to corrode quickly and fail. When it fails, it generally cannot be repaired using commonly available components; but rather, the entire hinge and hinge-spring assembly must be replaced. As a consequence, not only is its repair an annoyance, it is unnecessarily expensive.

Magnets, on the other hand, do not discourage animals from using the door, however, they are not particularly reliable. After repeated use, the magnets become misaligned and no longer hold the door shut as intended.

Another shortcoming exists in designs using a single door which swings both ways to allow the animal to both come and go. In such doors, there is by necessity a small gap around the door which allows in unwanted drafts, rain and insects. Some designs have solved this problem by using two doors, an inner door mounted within an outer door. The outer door has a lip on one side which acts as a seal and permits the door to swing only in one direction; whereas, the inner door has a lip on the opposite side which also acts as a seal but permits that door to swing only in the opposite direction. Thus, for example, the animal exists by pushing the outer door open and enters by pushing the inner door open. Obviously, these designs have twice as many moving parts as the single door designs and are more complicated. Thus, they present greater opportunity for failing and prove to be less durable.

SUMMARY OF THE INVENTION

The invention is an easily opened, reliable kennel doorway that seals out drafts, insects and rain when it is closed. The kennel doorway comprises a frame in which is mounted a door that pivots about a vertical axis substantially bisecting both the door and the frame. The door pivots about the axis within an opening defined by the frame. An extension spring, with one end anchored to the frame, urges the door to pivot in one direction to a closed position. The spring is situated within the frame and is protected from the outside elements by the frame. Door seals, attached to the frame and around the periphery of the opening, provide a stop against which the panel comes to rest when it reaches the closed position. The seals are situated on opposite sides of the door so that the door can pivot from the closed position in one direction but not in the other direction. In addition. the seals substantially circumscribe the opening in the frame and cover a gap which exists between the outer perimeter of the panel and the frame.

The spring normally holds the door in a closed position. An animal can easily open the door by pushing against an appropriate side of the door, causing it to pivot in a direction, away from the seals, to an open position, thereby allowing the animal to pass through. After the animal passes through, the spring urges the door back to its closed position with the door seated against the seals. To return through the door from the other direction, the animal pushes against the other side of the door at a diametrically opposite location to again cause it to pivot away from the seals to its open position.

BRIEF DESCRIPTION OF THE DRAWINGS

This invention is pointed out with particularity in the appended claims. The above and further advantages of the invention may be better understood by referring to the following description in conjunction with the accompanying drawings, in which:

DETAILED DESCRIPTION OF AN ILLUSTRATIVE EMBODIMENT

Figure 1:
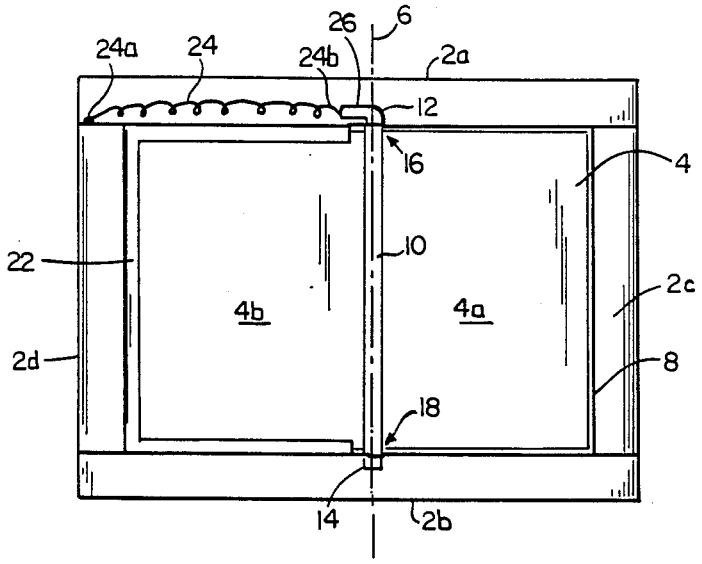
FIG. 1 is a front elevational view of a kennel doorway which embodies the invention.
Figure 2:
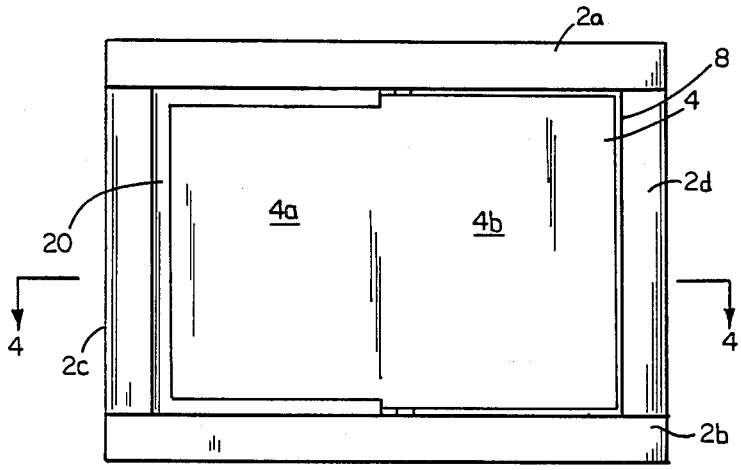
FIG. 2 is a back elevational view of the kennel doorway shown in FIG. 1.
Figure 3:
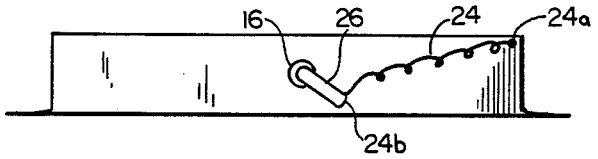
FIG. 3 is a top view of the kennel doorway shown in FIG. 1.

As illustrated in FIGS. 1, 2 and 3, the kennel doorway comprises a frame 2 in which is mounted a door 4 that pivots about a vertical axis 6. The frame 2 has a top member 2*a* and a bottom member 2*b* joined on either left and right ends of a left side member 2*c* and a right side member 2*d*, respectively, to define an opening 8 through which the door 4 can pivot. The door 4 is attached to a hinge rod 10 such that the rod 10 substantially bisects the door 4, thereby creating a left panel 4*a* and a right panel 4*b* of approximately equal dimensions. Located at opposing ends of the rod 10 are a top pivot pin 12 and a bottom pivot pin 14. The top pivot pin 12 is held by a top bearing 16 which is attached to the top member at substantially the midpoint thereof. Similarly, the bottom pivot pin 14 is held by a bottom bearing 18 which is attached to the bottom member 2*b* also at substantially the midpoint thereof. The bearings 16 and 18 hold the hinge rod 10 so that it is oriented along the vertical axis 6 and permit the rod 10 and the attached door 4 to pivot about the axis 6.

Figure 4:
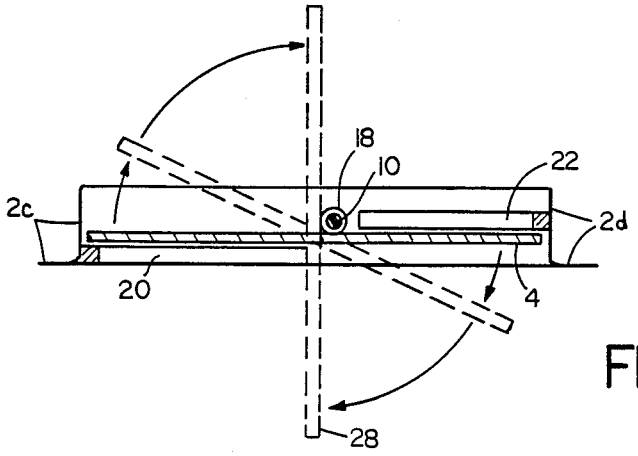
FIG. 4 is a top cross-sectional view of the kennel doorway shown in FIG. 1.

Distributed around the periphery of the opening 8 and affixed to the frame 2 are a left door seal 20 and a right door seal 22. The left door seal 20 is located along the left portion of the frame which extends from the vicinity of the top bearing 16 along the left side member 2*c* to the vicinity of the bottom bearing 18. Similarly, the right door seal 22 is located along the right portion of the frame which extends from the vicinity of the top bearing 16 along the right side member 2*d* to the vicinity of the bottom bearing 18. As is clearly illustrated in FIG. 4, the left seal 20 and the right seal 22 are disposed in relationship to the door 4 so that they permit the door 4 to pivot from the closed position in an open direction, but not in the opposite direction. In addition, the thickness of the seals 20 and 22 is greater than the width of the gap between the door 4 and the frame 2. Thus, the seals 20 and 22 prevent rain and wind from coming in through the gap when the door is closed.

As depicted in the top view of FIG. 3, an extension spring 24, which is dispposed on the inside of the top member 2*a*, biases the door 4 in a closed position. A first end 24*a* of the spring 24 is anchored to the frame 2 and a second end 24*b* of the spring 24 is connected to a lever arm 26 that extends radially off of the top pivot pin 12. The spring 24 urges the door 4 to pivot toward the closed position; thereby biasing it in a closed position against the door seals 20 and 22. An animal may exit through the door 4 by pushing against the left panel 4*b* (see FIG. 1) and causing the door 4 to pivot in an open direction to an open position 28. After the animal has passed through the opening, the spring 24 urges the door 4 back to its closed position. To return through the door from the other direction, the animal simply pushes against the right panel 4*a*, again causing the door 4 to pivot in the open direction to the open position 28. The ease of opening the door 4 and the rate at which it closes may be varied by using a spring 26 which is an adjustable type.

Of course, the height of the opening 8 should be large enough to permit the animal to easily pass through. Doors may be built to accommodate any size animal found in a kennel. Even in the case of a large dog, however, the opening 8 need not be greater than about thirty inches high.

Furthemore, the balanced design of the door makes it particularly resistant to being opened by the wind, while at the same time it is easily opened by animals. The force of the wind against the door panel tends to be evenly distributed over the surface of the door; the force on one side of the pivot urging the panel to open is counterbalanced by the force on the other side of the pivot urging the panel to remain closed. Since the door is not susceptible to being opened by winds, the spring force necessary to close the door and keep it closed need not be very great. Therefore, the animals using the door do not have to push against a strong spring force to make their way through the door.

In addition, the doorway provides an effective seal against drafts, rain and insects. Substantially all of the gap between the door and the frame is covered by the door seals when the door is closed.

Furthermore, the spring used to operate the door is both protected from the elements and is very serviceable. The frame shields it from the weather and from the moisture and corrosive conditions commonly found in the kennel environment. Moreover, since it is a simple extension spring, it can be replaced with any comparable spring.

Having thus described exemplary embodiments of the invention, it will be apparent that various alterations, modifications and improvements will readily occur to those skilled in the art. Such obvious alterations, modifications and improvements, though not expressly described above, are nonetheless intended to be implied and are within the spirit and scope of the invention. Accordingly, the foregoing discussion is intended to be illustrative only, and not limiting; the invention is limited and defined only by the following claims and equivalents thereto.

What is claimed as new and desired to be secured by Letters Patent of the United States is:

1. A kennel doorway comprising:

a. a frame forming an opening, the frame having a top member and a bottom member interconnected on their left and right ends by a left member and a right member, respectively, the top and bottom members each having a bearing located at substantially the midpoint thereof;

b. a door mounted within the opening by means of a top pivot pin which is held by the bearing located in the top member and a bottom pivot pin which is held by the bearing located in the bottom member so that the door pivots about a vertical axis which substantially bisects the door and the opening;

c. an extension-type spring disposed on the inside of the top member and connected between the frame and a lever arm extending radially off of the top pivot pin, said spring urging the door to pivot in a first direction; and d. a door seal affixed to the frame and located along the periphery of the opening, said seal also providing a stop against which the door is biased by the spring when the door is in a closed position.

2. A kennel doorway as defined in claim 1 wherein said seal surrounds substantially the entire periphery of the opening.

* * * * *